United States Patent [19]

Bruening

[11] Patent Number: 4,457,446

[45] Date of Patent: Jul. 3, 1984

[54] VAPOR CLOSURE FOR FLEXURES IN FLOATING

[75] Inventor: Robert A. Bruening, Naperville, Ill.

[73] Assignee: Chicago Bridge & Iron Company, Oak Brook, Ill.

[21] Appl. No.: 342,789

[22] Filed: Jan. 26, 1982

[51] Int. Cl.[3] ..... B65D 88/46

[52] U.S. Cl. ..... 220/224; 220/216; 220/227; 220/DIG. 19

[58] Field of Search ..... 220/216–227, 220/DIG. 19

[56] References Cited

U.S. PATENT DOCUMENTS

| | | | |
|---|---|---|---|
| 2,586,813 | 2/1952 | Goldsby et al. | 220/224 |
| 4,262,701 | 4/1981 | Beacom | 220/DIG. 19 X |
| 4,291,803 | 9/1981 | Perales | 220/225 X |
| 4,353,477 | 10/1982 | Bruening | 220/224 |

OTHER PUBLICATIONS

Chicago Bridge & Iron Company; Plate B–2, P. B–2, copyright, (1947) Bulletin B, Horton Double-Deck Floating Roof.

*Primary Examiner*—Allan N. Shoap
*Assistant Examiner*—Robert Petrik
*Attorney, Agent, or Firm*—Marshall, O'Toole, Gerstain, Murray & Bicknell

[57] ABSTRACT

In a liquid storage tank having a floating roof with a circular rim, a substantially ring-like vertical cylindrical shoe adapted to slide along the inside wall surface of the tank outwardly from the roof rim, a primary flexible seal extending from the roof rim to the shoe, and with the shoe containing a plurality of vertically positioned spaced apart flexures in the form of an open ended trough which terminates below the shoe top edge and with a longitudinal opening substantially flat against the tank wall, the improvement comprising a flexure closure of resilient polymeric material with a lower body portion inside the open top end of a substantial number of the flexure troughs, with the lower body portion being in contact with the trough; and with the flexure closure having a thin flat upper portion placed by the shoe inside surface.

2 Claims, 5 Drawing Figures

FIG. 1
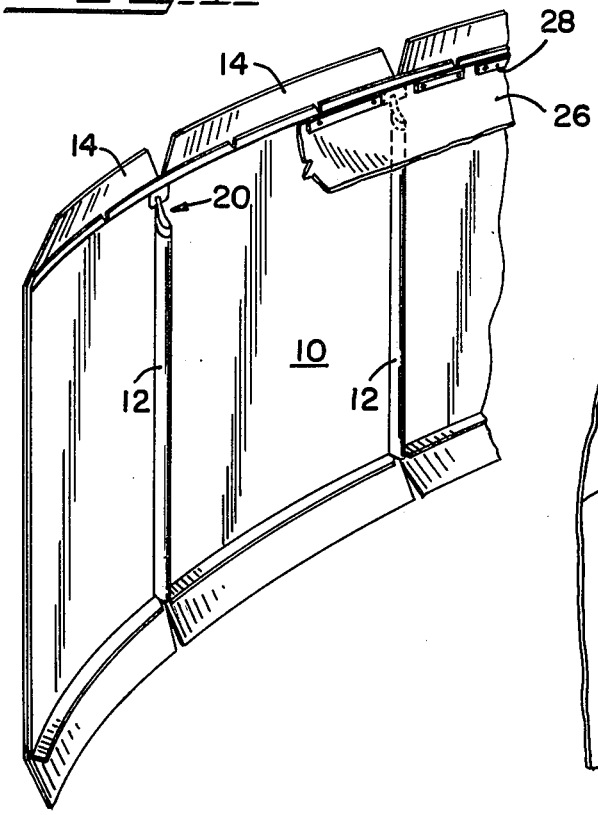
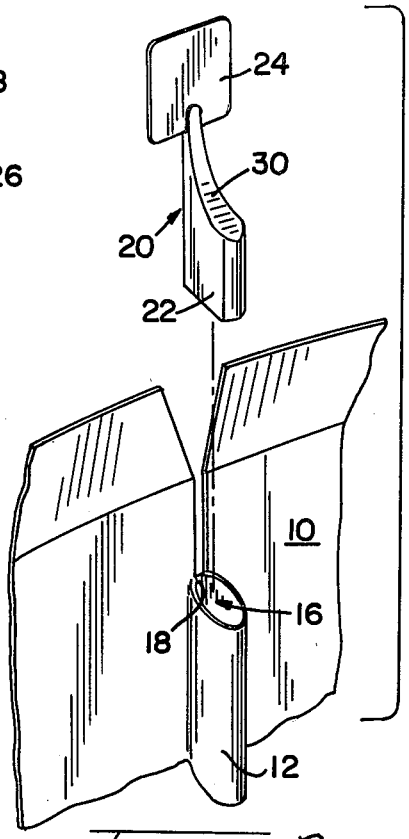
FIG. 2
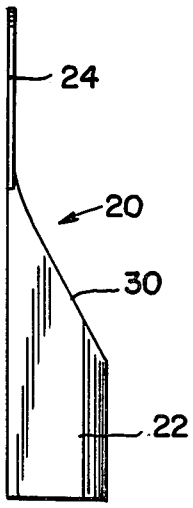
FIG. 3
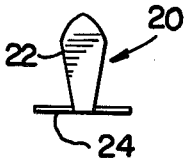
FIG. 5
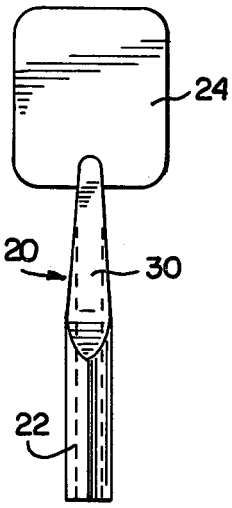
FIG. 4

VAPOR CLOSURE FOR FLEXURES IN FLOATING

This invention relates to closures. More particularly, this invention is concerned with an improved closure for use in a floating roof tank for preventing product vapor from escaping from the rim space.

BACKGROUND OF THE INVENTION

In a conventional floating roof tank, there is provided a clearance space or rim space between the tank side wall and the vertical rim or edge of the roof. It is necessary to provide a clearance space to permit unrestrained vertical travel of the roof within the tank. The clearance space is of sufficient size so that local dimensional variations in the circularity of the tank sidewall or shell, commonly called out-of-roundness, which can result from uneven foundation settlement, imprecise fabrication or erection, or unusual live loads such as high winds and the like, do not hamper vertical travel of the roof.

One apparatus used to maintain the roof centered in the tank and to effect a seal against evaporation loss uses a vertical, metallic shoe adapted to slidably contact the entire circular vertical inner side wall of the tank and means supported by the roof, such as pantagraph hangers, for pressing the shoe against the inner side wall, as well as to support the shoe. Vapor loss between the roof and shoes is prevented by a flexible nonpermeable fabric barrier which extends from the upper part of the shoe to the floating roof top edge. Such apparatus is disclosed in many U.S. patents including U.S. Pat. Nos. 2,587,508; 2,630,937; 2,649,985 and 2,696,930.

Although such types of seals function quite well in commercial installations, some product vapor may still escape. One way in which vapor may escape is through the top of the flexure joints in the vertical shoe.

One type of vertical metal shoe which is widely employed has a plurality of spaced apart vertical flexures which permit the shoe circumference to increase or decrease within predetermined limits. The flexures are in the form of an integral open ended trough which terminates below the shoe top edge. The trough longitudinal opening will generally be substantially flat against the tank wall. Goldsby et al U.S. Pat. No. 2,586,813 discloses a floating roof tank with a rim space seal using a shoe having such flexures. When product vapor forms in the annular space between the shoe and floating roof, and conditions are right, some emissions may flow out through the small opening in the shoe above the upper ends of the flexure troughs, it was proposed as early as the Goldsby et al patent, supra, to plug the top of the flexures with a neoprene sponge and to put a flap over it. In addition, a sheet of neoprene was to be placed over any adjacent joints or gaps. Later, a one piece cover cap was put in use for the described purpose. Although these systems for sealing the flexure tops have been helpful in suppressing vapor emissions, the desire to lower even further vapor emissions into the atmosphere has resulted in a need to have available alternative flexure closures which are suitable for preventing vapor emissions.

SUMMARY OF THE INVENTION

According to a first aspect of the invention, there is provided a closure of resilient polymeric material, adapted for sealing the open top of spaced apart flexures vertically positioned in a substantially ring-like vertical cylindrical shoe which slidably moves along the inside wall surface of a liquid storage tank containing a floating roof, having a lower body portion adapted to be positioned inside and in contact with the open top end of the flexures, and having a thin flat upper portion capable of being placed by the shoe inside surface.

The flexure closure desirably has a sloped intermediate portion of progressively decreasing thickness extending upwardly from the bottom portion to the upper portion. Furthermore, the flat upper portion is generally wider than the flexure.

According to a second aspect of the invention there is provided an improved liquid storage tank having a floating roof with a circular rim, a substantially ring-like vertical cylindrical shoe slidably adapted to move along the inside wall surface of the tank outwardly from the roof rim, means by which the shoe is supported by the roof, a primary flexible seal extending from the roof rim to the shoe, and with said shoe containing a plurality of vertically positioned spaced apart flexures in the form of an open ended trough which terminates below the shoe top edge and with a longitudinal opening facing towards the tank wall, with the improvement comprising a flexure closure of resilient polymeric material with a lower body portion inside the open top end of a substantial number of the flexure troughs, with said lower body portion being in contact with the trough; and with the flexure closure having a thin flat upper portion placed by the shoe inside surface.

The flexure closure used in the tank desirably has a sloped intermediate portion of progressively decreasing thickness extending upwardly from the bottom portion to the upper portion. Furthermore, the flat upper portion advisably is wider than the flexure.

In the described improvement, the primary flexible seal outer longitudinal edge should usually be tightly clamped to the shoe with the flexure closure flat upper portions therebetween.

In a particularly useful form of the invention, the flexure closure lower portion is compressed in the flexure. This is best done when the flexure is being formed in the shoe since it is easier to seat the closure in the flexure before the flexure trough is shaped to its minimum size.

BRIEF DESCRIPTION OF THE DRAWINGS

FIG. 1 is an isometric view of a portion of a conventional ring-like vertical cylindrical shoe containing spaced apart vertical flexures in the top of which a closure of resilient polymeric material has been placed according to the invention;

FIG. 2 is an exploded enlarged view of the top portion of a flexure and closure shown in FIG. 1;

FIG. 3 is a side elevational view of the closure shown in FIGS. 1 and 2;

FIG. 4 is a front elevational view of the closure shown in FIG. 3; and

FIG. 5 is a bottom view of the closure shown in FIGS. 3 and 4.

DETAILED DESCRIPTION OF THE DRAWINGS

To the extent it is reasonable and practical, the same or similar elements or parts which appear in the various views of the drawings will be identified by the same numbers.

As shown in FIG. 1, substantially ring-like vertical cylindrical shoe 10, which is adapted to slidably move along the inside wall surface of a liquid storage tank, contains a plurality of spaced apart vertically positioned flexures 12. Optional sole or wear plates 14 can be attached to the outside of the shoe 10 so as to protect the shoe against wear, especially in tanks with protruding rivets and lap joints. The flexures 12, as clearly shown in FIG. 2, are in the form of an open ended trough 16 which terminates below the shoe top edge. The trough has a longitudinal opening 18 facing towards the tank wall.

The flexure closure 20, shown in all of the figures of the drawings, is made of a resilient polymeric material, such as polyurethane. Estane 58109 is a commercially available resilient polyurethane which can be used to make the closure 20 by molding.

Closure 20 has a lower body portion 22 adapted to be positioned inside of, and in contact with, the open top end of the flexures 12. The thin flat upper portion 24 of closure 20 is sized and shaped to be placed by, or in contact with, the shoe 10 inside surface.

The upper edge of flexible seal 26 lays over the closure flat portion 24 and in turn the seal retaining strips or bands 28 secure the closure and seal edge to the shoe by suitable fasteners, such as bolts or rivets. As is shown in the drawings, the thin flat upper portion 24 is substantially wider than the bottom portion 22.

The flexure closure 20 desirably has a sloped intermediate portion 30 of progressively decreasing thickness extending upwardly from the bottom portion 22 to the upper portion 24. The slope of the intermediate portion 30 is desirably concave so as to approximately match the arc of the seal 26, thereby keeping the closure from protruding against the seal.

The closure 20 is desirably placed in the flexure 12 before the flexure is completely bent to its final shape. Thus the closure bottom portion 22 is positioned in the top of partially formed flexure 12 and then the flexure formation is completed thereby compressing the closure bottom portion 22 tightly in the flexure trough top portion.

The foregoing detailed description has been given for clearness of understanding only, and no unnecessary limitations should be understood therefrom, as modifications will be obvious to those skilled in the art.

What is claimed is:

1. In a liquid storage tank having a floating roof with a circular rim, a substantially ring-like vertical cylindrical shoe adapted to slide along the inside wall surface of the tank outwardly from the roof rim, means by which the shoe is supported by the roof, a primary flexible seal extending from the roof rim to the shoe with the primary flexible seal having an outer longitudinal edge tightly clamped to the shoe, and with said shoe containing a plurality of vertically positioned spaced apart flexures in the form of open ended troughs which terminate below the shoe top edge and each with a longitudinal opening substantially flat against the tank wall, the improvement comprising:

a flexure trough closure of resilient polymeric material with a lower body portion inside the open top end of a substantial number of the flexure troughs, with said lower body portion being in contact with the flexure trough;

the flexure trough closure having a thin flat sheet upper portion, wider than the flexure trough, placed against the shoe inside surface and tightly clamped between the primary flexible seal outer longitudinal edge and the shoe inside surface; and the flexure trough closure lower body portion having an upper end which slopes upwardly from the front to the back of the lower body portion and merges unitarily with the thin flat upper portion, with said thin flat sheet portion having a lower edge located near the top of the sloped upper end so that the thin sheet portion remains entirely above the trough open top end.

2. A flexure trough closure of resilient polymeric material, adapted for sealing the open top end of spaced apart flexure troughs vertically positioned in a substantially ring-like vertical cylindrical shoe which slidably moves along the inside wall surface of a liquid storage tank containing a floating roof;

the flexure trough closures having a lower body portion adapted to be positioned inside and in contact with the open top end of the flexure troughs and a thin flat upper sheet portion capable of being placed by the shoe inside surface;

the lower body portion having an upper end which slopes upwardly from the front to the back of the body portion and merges unitarily with a thin flat sheet portion extending upwardly from the body portion, with said thin flat sheet portion having a lower edge located near the top of the sloped upper end so that in use the thin sheet portion remains entirely above the trough open top.

* * * * *

UNITED STATES PATENT AND TRADEMARK OFFICE

CERTIFICATE OF CORRECTION

PATENT NO. : 4,457,446

DATED : July 3, 1984

INVENTOR(S) : ROBERT A. BRUENING

It is certified that error appears in the above-identified patent and that said Letters Patent is hereby corrected as shown below:

In the title, after "FLOATING" insert --ROOF SHOE--;

column 1, line 51, change "troughs, it" to --troughs. It--.

Signed and Sealed this

*Sixth* Day of *November 1984*

[SEAL]

*Attest:*

GERALD J. MOSSINGHOFF

*Attesting Officer*

*Commissioner of Patents and Trademarks*